US006488816B1

(12) United States Patent
Klerelid

(10) Patent No.: US 6,488,816 B1
(45) Date of Patent: Dec. 3, 2002

(54) DRYING SECTION FOR DRYING A PAPER WEB IN A PAPERMAKING MACHINE

(75) Inventor: Ingvar Klerelid, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 26 days.

(21) Appl. No.: 09/596,000

(22) Filed: Jun. 16, 2000

Related U.S. Application Data

(60) Provisional application No. 60/141,683, filed on Jun. 30, 1999.

(30) Foreign Application Priority Data

Jun. 17, 1999 (SE) ..... 9902319

(51) Int. Cl.[7] ..... D21F 5/00; D21F 3/00

(52) U.S. Cl. ..... 162/359.1; 162/358.3; 162/361; 162/296; 34/111; 34/132; 34/618; 34/236

(58) Field of Search ..... 162/109, 117, 162/116, 358.1, 358.3, 358.5, 359.1, 360.2, 361, 296, 204–207; 34/108, 114, 111, 132, 143, 611, 618, 236, 619

(56) References Cited

U.S. PATENT DOCUMENTS

| | | | | | |
|---|---|---|---|---|---|
| 1,883,526 | A | * | 10/1932 | Bryan | 162/117 |
| 3,198,695 | A | * | 8/1965 | Justus | 162/359.1 |
| 3,981,084 | A | * | 9/1976 | Sobota | 34/123 |
| 4,144,124 | A | * | 3/1979 | Turunen et al. | 162/290 |
| 4,309,246 | A | | 1/1982 | Hulit et al. | |
| 4,324,613 | A | | 4/1982 | Wahren | |
| 4,720,325 | A | * | 1/1988 | Rausing et al. | 162/110 |
| 5,393,384 | A | | 2/1995 | Steiner et al. | |
| 5,439,559 | A | * | 8/1995 | Crouse | 162/358.5 |
| 5,556,511 | A | * | 9/1996 | Bluhm et al. | 162/206 |
| 5,701,682 | A | | 12/1997 | Chuang et al. | |
| 5,776,307 | A | | 7/1998 | Ampulski et al. | |
| 5,795,440 | A | * | 8/1998 | Ampulski et al. | 162/117 |
| 5,855,739 | A | * | 1/1999 | Ampulski et al. | 162/117 |
| 5,935,381 | A | * | 8/1999 | Trokhan et al. | 2/109 |
| 6,051,105 | A | * | 4/2000 | Ampulski | 162/117 |
| 6,182,375 | B1 | * | 2/2001 | Banerjee | 34/398 |
| 6,221,214 | B1 | * | 4/2001 | Kotitschke et al. | 162/210 |

FOREIGN PATENT DOCUMENTS

| | | | |
|---|---|---|---|
| DE | 43 21 403 | A1 | 1/1994 |
| DE | 196 54 345 | A1 | 6/1998 |
| EP | 0490655 | A1 | 6/1992 |
| WO | WO93/23613 | A1 | 11/1993 |
| WO | 93/23614 | * | 11/1993 |
| WO | WO98/55691 | A1 | 12/1998 |

* cited by examiner

*Primary Examiner*—Jose Fortuna
(74) *Attorney, Agent, or Firm*—Alston & Bird LLP

(57) ABSTRACT

A drying section for drying a web in a papermaking machine has a pre-drying section and a final drying section, wherein the pre-drying section includes a hot press formed by a first press member and a rotatable counter roll in engagement with each other so as to form a nip therebetween through which the web passes. The hot press further includes a heating device disposed in heat-transfer relation to the counter roll and operable to heat a surface region of the counter roll which then passes through the nip so as to heat the web therein, and an imprinting fabric arranged in an endless loop, the imprinting fabric defining an imprinting surface for imprinting the web and being arranged to pass through the nip of the hot press with the web against the imprinting surface such that the web is imprinted. The imprinting fabric continues to support the imprinted web downstream of the hot press at least up to the final drying section.

12 Claims, 3 Drawing Sheets

DRYING SECTION FOR DRYING A PAPER WEB IN A PAPERMAKING MACHINE

CROSS-REFERENCE TO RELATED APPLICATION

This application claims the benefit of U.S. Provisional Patent Application Ser. No. 60/141,683, filed Jun. 30, 1999, and Swedish Patent Application No. 9902319-4 filed Jun. 17, 1999.

FIELD OF THE INVENTION

The present invention relates to apparatus and methods for drying a continuous tissue paper web in a papermaking machine. The invention relates more particularly to a drying section and method in which the web is passed through a pre-drying section and a final drying section, wherein the pre-drying section has at least one press that includes a first press device and a counter roll arranged in contact with each other so as to form a press nip there between, and an endless fabric is arranged to pass through the press nip together with the web.

The term "tissue" as used herein is intended to include all kinds of soft hygiene paper, whether creped or not, including but not limited to handkerchief paper, bathroom tissue, and towel.

BACKGROUND OF THE INVENTION

In the production of soft paper or tissue at lower basis weights, which is used for the production of household paper such as paper towels and other sanitary products, it is a general requirement that the bulk, i.e., the ratio between the volume and the weight of the paper, should be substantially higher than for other types of paper. Paper with a high bulk exhibits a desired combination of softness and high water absorption capacity.

The present commercially used technology to dry a continuous tissue web in a drying section employs large-diameter cylinders, so-called Yankee dryers, which are steam heated internally, or employs porous cylinders (so-called TAD cylinders) on which thermal through-air drying of the web is performed by blowing hot air through the web, either outwardly from the inside of the cylinder or inwardly from the outside of the cylinder.

Use of Yankee dryers for drying tissue has a major disadvantage in that the smooth surface of the cylinder causes the web to be compressed as it is pressed onto the Yankee dryer by means of a press roll, which is wrapped by a felt that carries the web to the Yankee dryer. This is especially the case since the web generally is still relatively wet when it is transferred to the Yankee dryer, leading to its structure and bulkiness being impaired by the treatment on the Yankee dryer. Hence, in a conventional drying section for tissue, only limited bulk levels can be reached. Typically, the web is creped from the Yankee dryer in order to somewhat improve its softness and bulkiness, but generally that improvement is lost when the tissue is used and thereby becomes wet.

In the development of drying sections for tissue, it has also been suggested to pre-dry the web in a press section comprising one or more press nips, possibly of shoe press type. The pre-dried web is then finally dried on a conventional drying cylinder such as a Yankee dryer. A papermaking machine of this type, including a pre-drying section and a final drying section, is disclosed in U.S. Pat. No. 5,393,384, the web being carried by an impermeable belt through the drying sections. Although a certain beneficial effect results from this type of system, the pre-drying section cannot be made adequately efficient, since only limited linear loads can be used in the press nips in order to avoid compressing the tissue web and thereby reducing the bulk of the web. Consequently, one press is usually not sufficient to reach the desired dry content levels in the pre-drying section, and hence at least two presses have to be used, which requires more space, investment costs and energy. Despite using at least two presses, the resulting tissue becomes relatively flat and compact, with a bulk that is lower than the desired high bulk. Another problem with the use of such presses is that rewetting of the web at the outlet from the press nip usually occurs, which reduces the effectiveness of the press in dewatering the web.

Drastically improved bulk levels have been reached by the use of thermal through-air drying cylinders, i.e., TAD cylinders. Typically, the bulk is increased by about 60–200%, compared to the bulk levels that are reached with a conventional press nip followed by a Yankee dryer. Usually, the TAD cylinder is preceded by a suction apparatus, by which an imprinting pattern is achieved in the web in its wet state. The web is thereafter dried in the TAD cylinder, by inward or outward air flow, while retaining the structure of the imprinting pattern and thereby retaining the high bulk of the web. In the TAD drying, the imprinted web structure is, in a matter of speaking, frozen in its structure.

The TAD cylinder, however, has the disadvantages that it requires a lot of space, has a limited capacity, and yet requires a lot of energy. Moreover, the TAD cylinder requires the use of very large air volumes that have to be handled. Also it entails high investment costs.

Another known method to dry a fibrous web is to use so-called impulse drying. The wet web is pressed at a high temperature and with a high linear load in a press section comprising one or more press nips. The technique is described in SE 7803672-0, corresponding to U.S. Pat. No. 4,324,613, and is used in web types other than tissue webs, or for tissue webs with limited bulk. In these patents, there are described maximum specific pressures of 3–8 MPa and surface temperatures on the counter roll of a press of conventional type of between about 150° C. and 350° C. By "conventional type" is meant a press nip in which two rolls with cylindrical cross sections are counter-acting against each other under pressure. The time that a given region of the moving web resides in this type of press nip, however, is only a few milliseconds because of the short length of the press nip in the machine direction, which is too short a time for the beneficial effects of the high pressure acting at a high temperature to be fully developed. Therefore, it has also been suggested to use impulse drying in a heated shoe press in which the press nip is extended to about 20–30 cm, giving much longer residence times for the web in the nip.

U.S. Pat. No. 5,556,551 discloses such an impulse drying process for drying paper webs such as toilet paper. The web and a water absorbing felt are fed into a press nip of a shoe press. The web may be heated by steam prior to its entry into the nip, or the smooth surface of the counter roll may be heated prior to the nip. Delamination, caused by the sudden expansion of flash steam when the web leaves the high-pressure nip, is said to improve the volume and softness of the web. The dried web is creped from the counter roll by a scraper. High bulk levels cannot be reached by the process of U.S. Pat. No. 5,556,551, since the web will be compressed in the nip between the absorbing felt which has a flat surface and the smooth surface of the counter roll.

Yet another known method to dry tissue web is to use a drying cylinder, such as a Yankee dryer, as the counter roll in a press nip. The roll that co-acts with the counter roll may also be equipped with a press shoe so that an extended nip is formed. Systems of this type are shown in DE 196 54 345 (FIG. 5) and DE 43 21403 (FIG. 11). The press shoe may include a heating device. In U.S. Pat. No. 3,806,406, there is shown a system for the formation of a tissue web, which system also is of the type with a press nip between a first roll and a Yankee dryer. This system seeks to avoid compressing of the high-bulk tissue web by providing the surface of the Yankee dryer with a relief pattern with depressions and elevated parts therebetween. Essentially, only the parts of the web that abut the elevated parts of the cylinder surface are pressed together in the press nip, the intermediate parts being relatively unaffected. The web is thereby provided with an imprinting pattern consisting of parts that are pressed together and other parts that are not pressed together, corresponding to the pattern of the cylinder surface.

Despite several methods, devices and systems being known for drying tissue webs, there is no commercially available drying section that gives a high bulk, high water absorption levels, a good softness, and a distinct imprinting pattern in the web, while also requiring only a relatively small space, entailing relatively low investment and energy costs, and yet having a high capacity and good reliability.

SUMMARY OF THE INVENTION

The above needs are met and other advantages are achieved by the present invention, which provides a drying section for drying a web in a papermaking machine, the drying section comprising a pre-drying section and a final drying section, wherein the pre-drying section includes a hot press formed by a first press member and a rotatable counter roll in engagement with each other so as to form a nip therebetween through which the web passes. The hot press further includes a heating device disposed in heat-transfer relation to the counter roll and operable to heat a region of the exterior cylindrical surface of the counter roll, which then passes through the nip so as to heat the web therein, and an imprinting fabric arranged in an endless loop, the imprinting fabric defining an imprinting surface for imprinting the web and being arranged to pass through the nip of the hot press with the web against the imprinting surface such that the web is imprinted. The imprinting fabric continues to support the imprinted web downstream of the hot press at least up to the final drying section.

Since the terms "impulse dryer" and "impulse drying" imply that water in the web evaporates so violently that the formed steam blows out liquid water from the web, the more generic terms "hot press" and "hot pressing" are used to describe the present invention.

Preferably, the surface region of the counter roll is arranged to be heated by an external heating element to a temperature of at least 150° C., and more preferably 200–300° C. The external heating element is arranged at a location other than where the web is carried by the counter roll, preferably just ahead of the press nip.

In one embodiment, the imprinting fabric is arranged to maintain the web against the counter roll over a sector of the counter roll subtending an angle of about 90° to 300°. Accordingly, the web remains in contact with the heated surface of the counter roll for an extended period of time so that the drying of the web is performed for a greater time. The hot press can also include a ventilation hood surrounding a portion of the sector of the counter roll wrapped by the web for carrying away steam liberated from the web. Alternatively, the pre-drying section can be arranged to lead the web away from the first press device and the counter roll essentially immediately downstream of the press nip. One advantage of this arrangement is that a higher temperature may be used on the counter roll without risk of the (synthetic) fabric being destroyed.

Preferably, in every location in the drying section where the web is pressed or subjected to a load between two surfaces, such as between the surface of a roll or cylinder and a fabric or clothing, or between two surfaces in a press nip, at least one of said two surfaces exhibits a structured/coarse surface. In the case of the structured/coarse surface being a fabric or a clothing, it preferably is a permeable imprinting fabric or clothing. In the case of the structured/coarse surface being the mantle surface of a roll or cylinder, it is a surface with a relief pattern. In this way, the web is never completely compressed between two flat or smooth surfaces in the drying section, whereby it retains a high bulk, a good softness and good water absorption levels, the structure of the web being essentially retained even when it is re-wetted when used.

The first press member can be a cylindrical roll or can include a press shoe forming an extended nip with the counter roll. Preferably, the drying section also includes a clothing operable to carry water away from the web. The clothing is arranged in an endless loop such that the clothing passes through the nip with the imprinting fabric sandwiched between the clothing and the web and then separates from the imprinting fabric and the web downstream of the nip.

The drying section can also include at least one suction device disposed upstream of the nip for suctioning the web against the imprinting surface of the imprinting fabric such that the web is made to conform to the imprinting surface.

The final drying section in some embodiments includes a heated dryer roll, and the imprinting fabric loop includes a guide roll that forms a nip with the heated dryer roll through which the imprinting fabric with the web supported thereon passes. The web is transferred from the imprinting fabric onto the heated dryer roll at the nip, and the web is then carried about the heated dryer roll for final drying of the web. Since the web is pressed onto the heated dryer roll by the imprinting fabric, the web is not compressed between two smooth surfaces, and hence the imprinted web is finally dried in its imprinted condition, which tends to lock the imprinted structure into the web so that it remains even upon re-wetting of the web.

In other embodiments, the final drying section includes a rotary through-air dryer having a drying cylinder about which the imprinting fabric is wrapped so as to carry the web about the drying cylinder. In yet other embodiments of the invention, the final drying section includes a rotary through-air dryer having a drying cylinder and further includes a drying fabric arranged in an endless loop so as to pass over the drying cylinder. The imprinting fabric loop is arranged to transfer the web from the imprinting fabric onto the drying fabric upstream of the drying cylinder, and the drying fabric carries the web about the drying cylinder.

The counter roll may be a solid cylindrical body, or may comprise a heatable, rotatable sleeve that surrounds a rotatable roll body. A region of the exterior cylindrical surface of the sleeve is heated by an external heating element. The sleeve preferably loosely surrounds the roll body in order to allow free expansion of the sleeve in relation to the roll body as the sleeve is heated. The sleeve and the roll body are eccentrically arranged in relation to each other such that the sleeve is in contact with the first press device in the press nip and also is in contact with the roll body in the press nip, so that a linear load is conveyed from the roll body to the nip via the sleeve. The rotation of the sleeve is driven by the rotation of the roll body, the friction between the roll body end the sleeve forcing the sleeve to rotate with the same peripheral speed as the roll body. By this construction, temperature-related stress in the counter roll is substantially avoided. Such stress may occur with a solid cylindrical counter roll because the outer layer of the roll becomes hotter than the inner layers of the roll, and hence the outer layer will expand more than the inner layer, resulting in temperature-induced stresses. Also, with a solid roll it may be difficult to maintain the desired geometrical shape of the roll across the machine direction because of difficulties in maintaining the same temperature in the mantle surface as in the gables. With a sleeve that is loosely arranged around the roll body, these types of problems are avoided. Another advantage with the exchangeable sleeve is that the imprinting pattern may be changed relatively simply, by changing sleeves.

Preferably, the hot press is arranged to provide an outgoing dry content of 40–60%, and more preferably 45–55%, in the web, when the incoming web to the press has a dry content of 10–30%, and more preferably 20–30%. Accordingly, the dry content of the web is raised 10–50% in the hot press nip. Although not preferred, it is possible to use more than one press nip in the pre-drying section, the additional press nip(s) being of conventional wet press type or of impulse drying type.

The press nip is preferably arranged to provide a linear load of 200–800 kN/m, and more preferably 300–600 kN/m, between the first press device and the counter roll. The counter roll may have a smooth surface, at least if the fabric that carries the web through the nip has a structured, imprinting surface. Alternatively, the mantle surface of the counter roll may have a patterned, imprinting surface, with depressions with a depth of preferably 0.1–2.0 mm, and parts between the depressions, i.e. elevated parts, preferably having a width of 1–5 mm. The surface area of the elevated parts, i.e. the surface area which will be in contact with the web, constitutes 20–50% of the total surface area of the mantle surface, measured at the circumference of the mantle. If both the permeable fabric and the counter roll are provided with imprinting patterns, the tissue product will beneficially be imprinted on both sides. Preferably, the counter roll has a diameter of 2.0–3.6 m.

According to another aspect of the invention, pressurized air knives or the like are arranged to release the web from the surface of the counter roll.

By the combination, according to the invention, of a pre-drying section based on hot pressing technique and a final drying section that may include a drying cylinder such as a Yankee dryer or a TAD cylinder or other drying means known in the art, and with the web never being compressed between two flat or smooth surfaces in the drying section, a tissue web is produced with very high bulk levels and with structural properties very similar to the structural properties of TAD-dried tissue webs. The tissue web is pre-dried to a relatively high dry solids content before the final drying of the web, which means that the imprinted structure of the web will not be impaired when it is conveyed to a drying cylinder such as a Yankee dryer. At the same time, the energy demand is decreased in comparison with the energy demand for TAD drying, and the investment cost and space requirement is lowered. The efficient drying in the pre-drying section, ensured by the press nip with hot pressing, makes it possible to increase the speed of the tissue paper machine. Alternatively, smaller-diameter drying cylinders can be used in the final drying section; in this case of a TAD cylinder used in the final drying section, this means that smaller air flows are required. When the present invention is applied to the reconstruction of an existing papermaking machine, the capacity of the machine may be increased without requiring any extra space, and also the efficiency and reliability of the machine can be improved.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
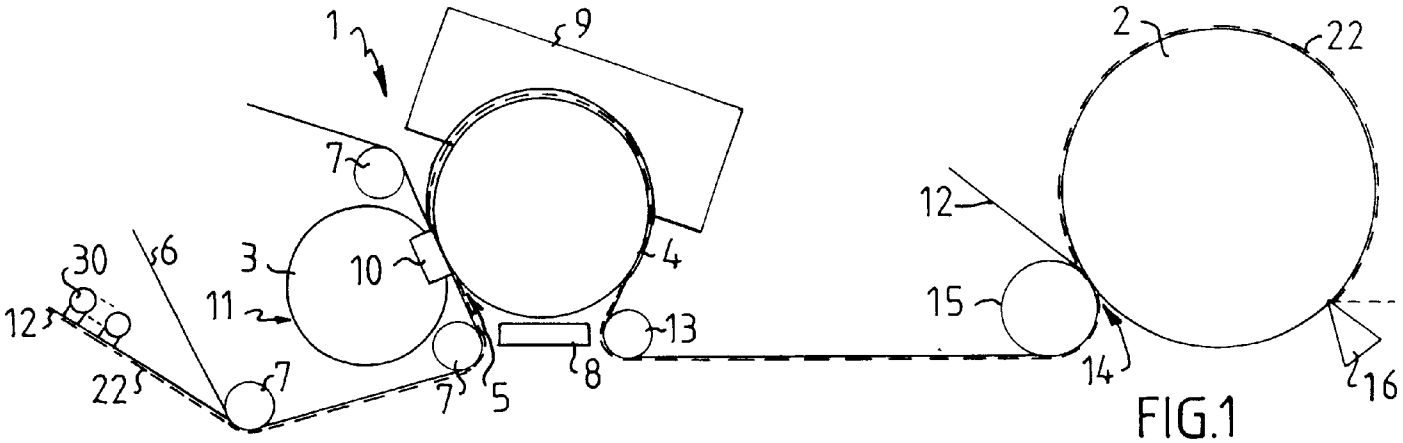
FIG. 1 is a schematic illustration of a first embodiment of the invention, comprising a press with the web wrapped around the counter roll, followed by a Yankee dryer.

In the embodiment shown in FIG. 1, a pre-drying section includes a hot press, which is generally denoted with the reference numeral 1, and a final drying section with a drying cylinder 2, which in this first embodiment is a Yankee dryer. The hot press 1 comprises a first roll 3, a counter roll 4, which together with the first roll 3 forms a press nip 5, and an endless papermaking machinery fabric 12, which is in direct contact with the web 22. The fabric 12 has the ability to receive water from the web in liquid phase or in gas phase.

The pre-dryer also preferably includes a vacuum device 30 that sucks the web onto, and partially into, the permeable coarse open structure of the fabric 12 at a location prior to the press 1. Accordingly, the web 22 is arranged on an opposite side of the fabric 12 from the vacuum device 30.

The counter roll 4 is made of a solid cylindrical body, provided with shaft pivots (not shown), for rotatable journalling in bearings (not shown) by a motor (not shown). The counter roll 4 is provided with a movable (e.g., oscillating)

or stationary external heating element 8, which heating element is arranged to heat a region of the exterior cylindrical surface of the roll 4 just prior to the entry of that surface region into the press nip 5. The heating may be effected by induction heating, heating by gas burner, or other means known per se in impulse drying. The web 22 is arranged to wrap a substantial part of the circumference of the counter roll 4, thereby additionally drying the web on the hot surface of the roll after the press nip 5. A ventilation hood 9 is arranged to ventilate at least a part of the surface of the counter roll 4 at a location where the web is carried by the roll. The web will release readily from the surface of the counter roll at temperatures of above 200° C. This is especially the case since the web is relatively firmly held by the mesh structure of the fabric 12. If necessary, air knives or the like (not shown) may be arranged to aid in the releasing of the web from the roll surface. If needed, the mantle surface of the counter roll 4 may be cleaned by a doctor blade, a brush (preferably a metal brush), or by air knives (not shown).

The impulse drying in the heated press nip 5 may result in beneficial effects on the bulk of the web. Although not wishing to be bound by theory, it is thought that this is caused by the sudden expansion of flash steam when the web leaves the high-pressure nip. Thereby, there is attained an advantageous increase in bulk/volume and softness of the web.

Optionally, the temperature of the web 22 may be increased before the press nip 5 by one or more steam blow boxes (not shown) arranged on the free side of the web. Pre-heating of the wet web gives the water a lower viscosity, which facilitates the pressing of the water from the web in the press nip 5.

The mantle surface of the counter roll 4 is preferably, but not necessarily, provided with an imprinting pattern, whereby the web 22 will be imprinted on the side thereof that faces the mantle of the counter roll 4. Since the fabric 12 is provided with an imprinting pattern, the web will, in this case, be imprinted on both sides. In addition to the advantage of having the web imprinted on both sides, which increases its bulk and softness, the pattern of the mantle surface of the counter roll 4 leads to the web essentially only being compressed by the press nip 5 in the parts of the web that are affected by the elevated parts of the imprinting pattern, i.e., the parts between the depressions of the pattern. The intermediate parts that correspond to the depressions of the pattern are relatively unaffected. In these parts, the tissue web will be allowed to expand by the steam in the depressions, giving a tissue of high bulk. The web is thereby provided with an imprinting pattern, consisting of parts that are pressed together and other parts that are not pressed together, corresponding to the pattern of the surface of the roll. Even if the mantle surface of the counter roll 4 is smooth, a similar effect will be achieved by virtue of the open mesh structure of the fabric.

In the embodiment of FIG. 1, the hot press 1 is a shoe press with an extended press nip 5, the first roll 3 being a shoe press roll having a press shoe 10. The mantle of the first roll 3 thereby consists, as is conventional for a shoe press roll, of an impermeable, flexible jacket 11. The press shoe 10 has a concave surface (denoted with the reference numeral 23 in FIG. 6) to follow the convex surface of the counter roll 4, whereby the extended nip 5 is formed. The flexible jacket 11 of the first roll 3 runs through the press nip 5, in sliding contact with the concave surface of the press shoe 10. As an alternative, a press belt may be substituted for the flexible jacket 11 and may run in a loop about a plurality of guide rolls (not shown), the press shoe being mounted in the loop.

The clothing 6 of the shoe hot press 1 is arranged to run in a loop around a plurality of guide rolls 7 and through the extended nip 5. The web 22 is carried by the fabric 12 and is led together with the clothing 6 to the press nip 5. The web is separated, together with the fabric, from the clothing after the press nip, in order to lie on the surface of the counter roll 4 as described above. Preferably, the clothing 6 consists of a press felt, but alternatively the clothing can be a permeable belt having through apertures, and possibly depressions between the apertures, or an impermeable belt with depressions of suitable depth, shape and extension. The apertures and depressions are arranged to receive liquid and to carry it away from the web and out of the press nip 5. As another alternative, a suction device or any other known means may be used for carrying and withdrawing the moisture from the press nip.

Instead of or in addition to the permeable or impermeable belt 6, the pre-dryer also includes a permeable imprinting fabric 12 to carry the web at least through the pre-drying section. The fabric is preferably made of a synthetic and/or metal material and has an open coarse structure of about 35–50 mesh, both in the machine direction and in the cross direction.

The illustrated hot press 1 with a press shoe 10 is the preferred embodiment, but alternatively other types of hot press devices, such as a conventional roll press having a cylindrical press roll that cooperates with the hot counter roll 4 to form a press nip, may be used in the invention.

Downstream of the hot press 1, after the web 22 has been released from the surface of the counter roll 4, the web, and preferably also the fabric 12, is led, optionally via one or more guide rolls 13, to a drying cylinder 2 or other drying equipment, for final drying. In the first embodiment of FIG. 1, the drying cylinder 2 is a Yankee dryer. The web 22 is led into a transfer nip 14 between the drying cylinder 2 and a cylindrical transfer roll 15. The linear load of the transfer nip 14 preferably is very low. It is essentially only enough to transfer the web onto the drying cylinder. The web follows the Yankee dryer 2 around a greater part of its circumference, and is thereby dried by the warm mantle surface thereof. The Yankee dryer is of a conventional type, including a hood and other components (not shown), as known in the art. However, the Yankee dryer 2 may have a somewhat smaller diameter than a conventional Yankee dryer. When the drying is completed, the web may be creped off from the mantle surface of the dryer with the aid of a creping doctor 16. Alternatively, it may be led away without being creped.

If needed, the Yankee dryer may be followed by a light calender for improving a tactile feel of the web, or by other drying devices such as a through-air drying cylinder (TAD cylinder) or the like.

Figure 2:
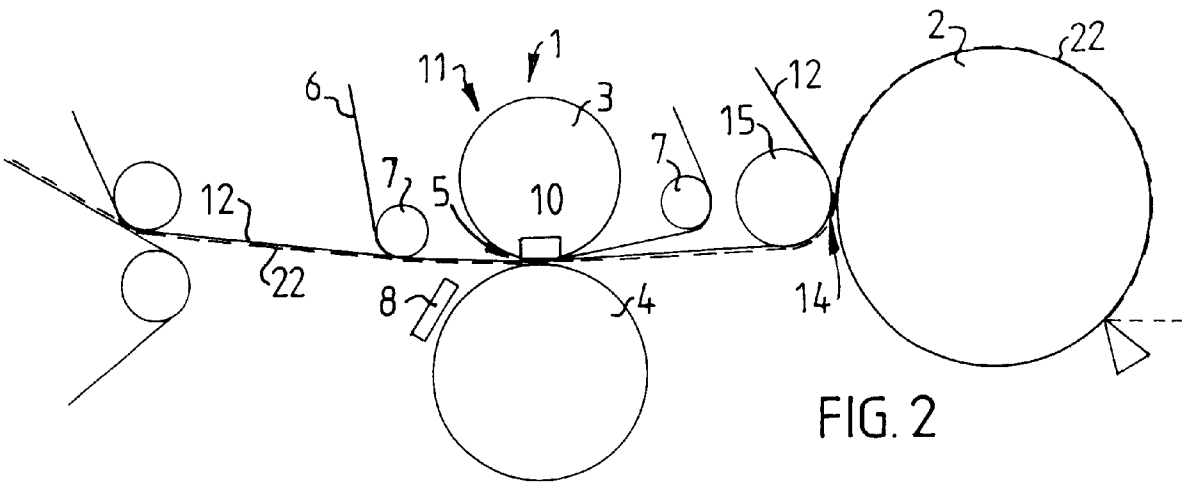
FIG. 2 is a schematic illustration of a second embodiment of the invention, comprising a press without web wrap around the counter roll, followed by a Yankee dryer.

In FIG. 2, there is shown a second embodiment of the invention, comprising a hot press 1 without web wrap around the counter roll 4, followed by a Yankee dryer 2. In this embodiment, the web passes through the nip between the first roll 3, which may be of shoe press type with an extended nip, and the heated counter roll 4. The web 22 is thereafter conveyed from the nip 5 to the Yankee dryer 2 by the fabric 12, without being carried around the circumference of the counter roll 4.

The web 22 is released from the roll 4 of the hot press 1, essentially directly after the press nip 5, by air knives or the like. The external heating element 8 may be arranged to heat the surface of the counter roll 4 at a location about 30°–300° prior the press nip. Accordingly, it may also be arranged in the vicinity of the outlet from the press nip, which is possible since the heat loss from the surface of the counter roll is relatively small before it comes in contact with the wet web in the press nip 5. In other respects, the second embodiment is generally similar to the one shown in FIG. 1.

Figure 3:
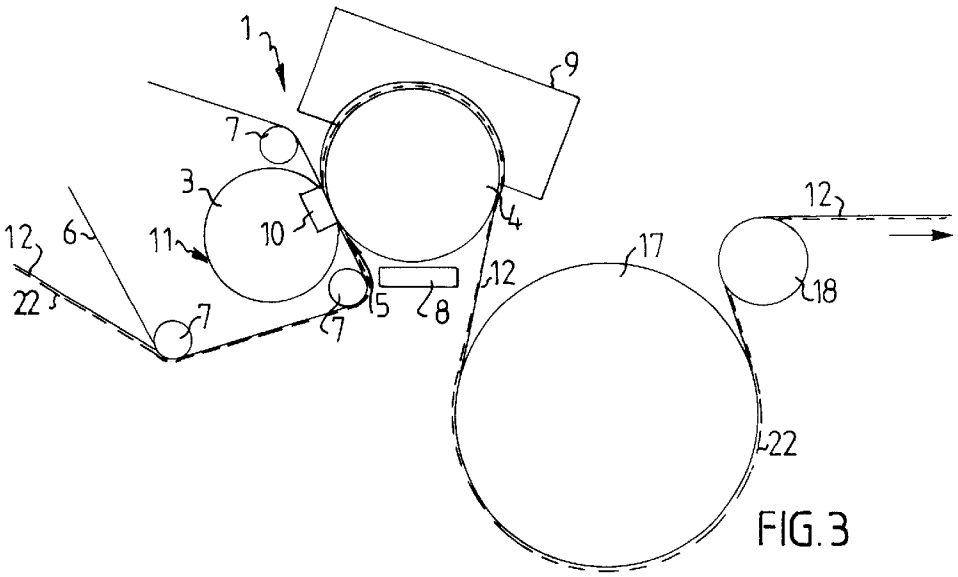
FIG. 3 is a schematic illustration of a third embodiment of the invention, comprising a press with the web wrapped around the counter roll, followed by a TAD cylinder with inward air flow.

In FIG. 3, a third embodiment of the invention is shown, comprising a hot press 1 with the web wrapped around the counter roll 4, followed by a thermal through-air drying cylinder (TAD cylinder) 17. The pre-drying section, comprising the hot press 1, is of the same configuration as the pre-drying section of FIG. 1. From the hot press 1, the web 22 is led, optionally via one or more guide rolls (not shown), on the fabric 12 to the drying cylinder 17. The web is arranged to be carried around a substantial part of the circumference of the drying cylinder 17, with the fabric 12, which is permeable, against the outer surface of the drying cylinder and the web supported on the outer surface of the fabric. The drying cylinder 17 is operable, via a hood (not shown), to draw air of temperatures up to 220° C. and velocities of about 5–10 m/s through the web, the fabric 12, and the mantle surface of the cylinder, i.e. with an inward air flow, whereafter the air flow is discharged from the interior of the cylinder through one end thereof and is recirculated with the aid of a circulation fan. Thus, the web is dried by the through-flowing air. The web is finally dried on the TAD cylinder 17, and is then conveyed by the fabric 12, via one or more guide rolls 18, to a reel (not shown) for winding into a tissue paper roll. Alternatively, the web can be conveyed after the TAD cylinder to other drying devices, such as a Yankee dryer or the like, for additional drying.

Figure 4:
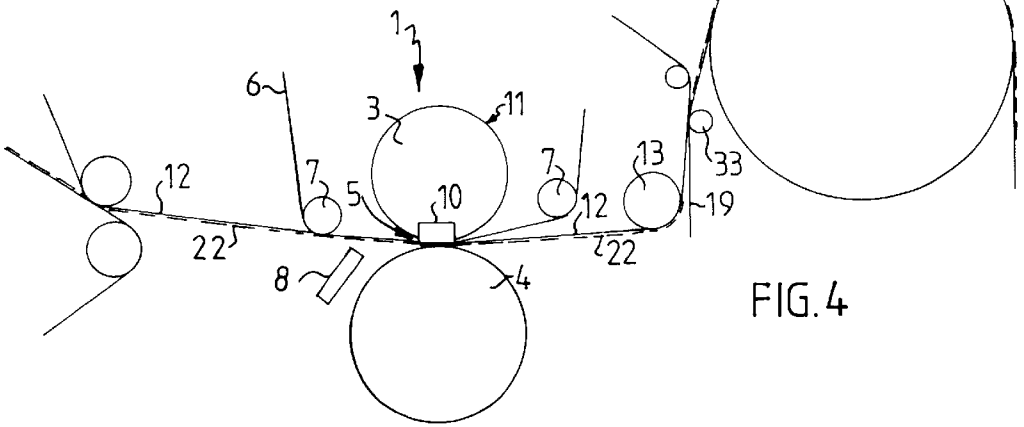
FIG. 4 is a schematic Illustration of a fourth embodiment of the invention, comprising a press without web wrap around the counter roll, followed by a TAD cylinder with inward air flow.

In FIG. 4, there is shown a fourth embodiment of the invention, comprising a hot press 1 without web wrap around the counter roll 4. The hot press 1 is of the same type as the one shown in FIG. 2. After the hot press 1, the web 22 is optionally transferred from the fabric 12 to a second fabric 19, which here is a TAD fabric, via one or more pick-up devices 33, and further to a drying cylinder 17. In this embodiment, the drying cylinder 17 is a TAD cylinder of the same configuration as the one shown in FIG. 3. After the TAD cylinder the web can be conveyed to further drying devices, such as a Yankee dryer (not shown), or can be conveyed to a reel (not shown) for winding.

Figure 5:
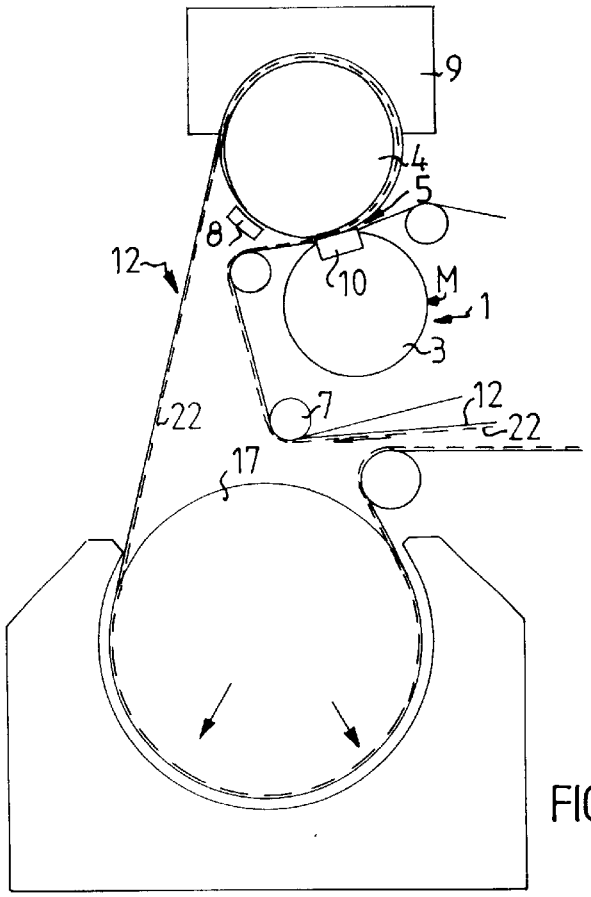
FIG. 5 is a schematic illustration of a fifth embodiment of the invention, comprising a press with the web wrapped around the counter roll, followed by a TAD cylinder with outward air flow.

FIG. 5 depicts a fifth embodiment of the invention, comprising a hot press 1 with the web wrapped around the counter roll 4, as in FIG. 1. After the hot press 1, the web 22 is conveyed, optionally via one or more guide rolls (not shown), to a TAD cylinder 17. In this embodiment, the TAD cylinder 17 is arranged with outward air flow from the interior of the cylinder through the web and the fabric. The web is thereby arranged to be carried around a substantial part of the circumference of the mantle surface of the cylinder, between the permeable fabric 12 and the cylinder 17.

Figure 6:
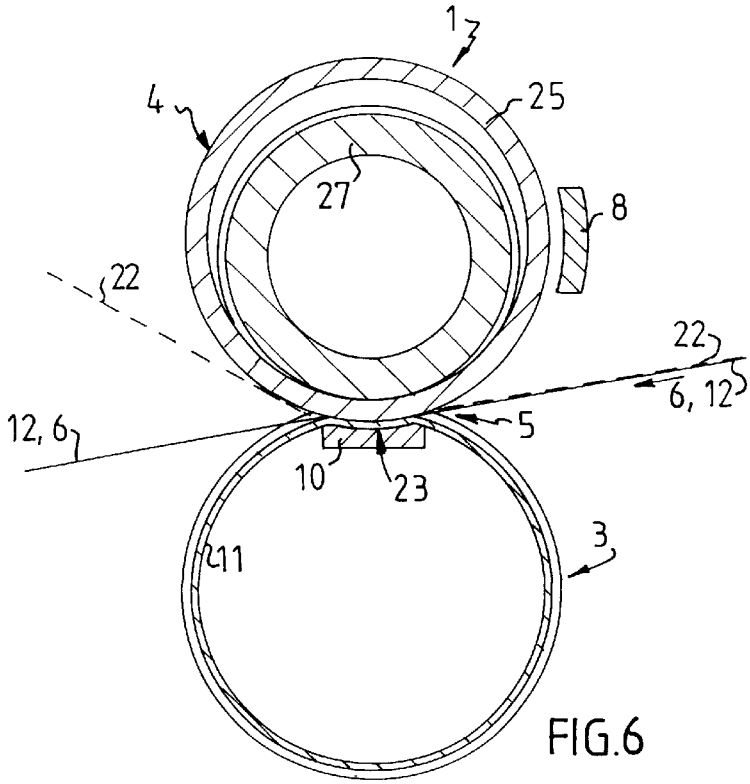
FIG. 6 shows a preferred embodiment of a counter roll in accordance with the present invention.

FIG. 6 shows an especially preferred embodiment in which the counter roll 4 is provided with a heatable, preferably exchangeable, sleeve 25, which is arranged to surround a roll body 27, preferably to loosely surround the roll body, in order to allow free expansion of the sleeve 25 in relation to the roll body 27, whereby undesired stresses are avoided. The sleeve 25 is movable and is arranged to continuously transmit heat to the web 22 when the web passes through the press nip 5. The sleeve 25 is heated from the outside by the external heating element 8. The sleeve 25 is preferably cylindrical and surrounds at least the axial part of the cylindrical roll body 27 that is active in the press nip 5. The sleeve 25 is free from mechanical, adhesive, or any other type of permanent, fixing connection to the roll body 27 that would prevent a free expansion of the sleeve 25, axially and/or radially, in relation to the cylindrical roll body 27.

The roll body 27 is arranged to press against the sleeve 25 at a location within the zone of the press nip 5, i.e., within the zone of the press shoe 10. The pressure between the sleeve 25 and the roll body 27 is high enough for the sleeve to be rotated by the roll body with the same peripheral speed at the location of contact therebetween. The sleeve 25 is arranged to rotate about its own center axis, which is eccentric in relation to the axis of rotation of the roll body 27. The sleeve 25 may be rigid and stable in shape, or flexible and thus not stable in shape. Generally, if it is rigid, it has a wall thickness of 5–100 mm, preferably 15–40 mm. By making the wall thickness of the sleeve 25 thick enough, the mantle surface of the sleeve can be treated as the surface of a conventional press roll, whereby it may be cleaned by a cleaning means, such as a doctor blade, a brush (preferably a metal brush), or by air knives (not shown). If the sleeve 25 is flexible, it may be a soft, flexible cylinder, with a wall thickness of 0.4–5.0 mm, preferably 0.8–2.3 mm. When the sleeve 25 is flexible, a doctor blade for cleaning may be arranged at a suitable location so that the sleeve 25 is bent towards the roll body 27, which will act as a support.

In accordance with yet another embodiment, the sleeve may also be permeable, which decreases the risk of the web sticking to the mantle surface of the sleeve. The mantle surface of the sleeve may be provided with through apertures and/or depressions, which constitute an imprinting pattern for the web. The pattern of the surface preferably is of the same configuration and dimensions as has been previously described in connection with the counter roll. The releasing of the web may also be facilitated by using air knives (not shown), for directing an intense air flow on the web, directly or through the sleeve.

The type of hot press 1 shown in FIG. 6 may be used in connection with any of the embodiments shown above. Accordingly, although not shown, it may also be used with the web wrapped around the sleeve 25, in the same way as the web is wrapped around the counter roll 4 in FIGS. 1, 3 and 5.

In the embodiments shown in FIG. 1 and 2, the tissue web will be given good properties, such as bulk and structure, in the pre-drying section, at the same time as it is pre-dried to such an extent that the properties not will be impaired by the final drying, even though a conventional Yankee cylinder is used for the final drying. Thus, the web will exhibit qualities that are comparable to the qualities of a TAD-dried web, without using TAD drying.

The same is true for the embodiments shown in FIG. 3, 4 and 5, although a TAD cylinder is used. The TAD cylinder, however, may be smaller than what usually is used for TAD cylinders, and may use smaller air flows than what is conventional.

Many modifications and other embodiments of the invention will come to mind to one skilled in the art to which this invention pertains having the benefit of the teachings presented in the foregoing descriptions and the associated drawings. For example, the TAD cylinder of FIG. 5 may be combined with a press without web wrap around the mantle surface of the counter roll. Further, the final dryer does not have to include a Yankee dryer and/or a TAD cylinder but may include a flat through-air drying system, or the drying system marketed under the trademark CONDEBELT by Valmet Corporation, and also infrared heaters may be used. Additionally, although in preferred embodiments of the invention the surface of the counter roll is heated by a heating device that is external to the counter roll such as an inductive heater, it is within the scope of the invention as defined in the claims to heat the counter roll from the inside. This may be accomplished, for example, with a gas-fired IR heater or hot oil in heat-exchanging relationship with the counter roll shell. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A drying section for drying a web in a papermaking machine, the drying section comprising a pre-drying section and a final drying section, wherein the pre-drying section includes a hot press comprising:

a first press member and a rotatable counter roll in engagement with each other so as to form a nip therebetween through which the web passes;

a heating device disposed in heat-transfer relation to a cylindrical exterior surface of the counter roll and operable to heat a region of said surface of the counter roll, the surface region then passing through the nip so as to heat the web therein; and an imprinting fabric arranged in an endless loop, the imprinting fabric defining an imprinting surface for imprinting the web and being arranged to pass through the nip of the hot press with the web against the imprinting surface such that the web is imprinted, the imprinted web continuing to be supported on the imprinting fabric downstream of the hot press at least up to the final drying section, wherein the imprinting fabric and web are arranged such that one side of the web is against the counter roll and the opposite side of the web is against the imprinting fabric as the web passes through the nip.

2. The drying section of claim 1, wherein the counter roll has a mantle defining a smooth surface that contacts the web.

3. The drying section of claim 1, wherein the counter roll has a mantle defining an imprinting surface that contacts the web and imprints the side of the web in contact therewith.

4. The drying section of claim 1, wherein the imprinting fabric is arranged to maintain the web against the counter roll over a sector of the counter roll subtending an angle of about 90° to 300°.

5. The drying section of claim 4, further comprising a ventilation hood surrounding a portion of said sector of the counter roll.

6. The drying section of claim 1, wherein the first press member includes a press shoe forming an extended nip with the counter roll.

7. The drying section of claim 1, further comprising a clothing arranged in an endless loop such that the clothing passes through the nip with the imprinting fabric sandwiched between the clothing and the web and then separates from the imprinting fabric and the web downstream of the nip, the clothing being operable to carry water away from the web.

8. The drying section of claim 1, further comprising at least one suction device disposed upstream of the nip for suctioning the web against the imprinting surface of the imprinting fabric such that the web is made to conform to the imprinting surface.

9. The drying section of claim 1, wherein the final drying section includes a heated dryer roll, and wherein the imprinting fabric loop includes a guide roll that forms a nip with the heated dryer roll through which the imprinting fabric with the web supported thereon passes, the web being transferred from the imprinting fabric onto the heated dryer roll at the nip.

10. The drying section of claim 1, wherein the final drying section includes a rotary through-air dryer having a drying cylinder about which the imprinting fabric is wrapped so as to carry the web about the drying cylinder.

11. The drying section of claim 1, wherein the final drying section includes a rotary through-air dryer having a drying cylinder and further includes a drying fabric arranged in an endless loop so as to pass over the drying cylinder, the imprinting fabric loop being arranged to transfer the web from the imprinting fabric onto the drying fabric upstream of the drying cylinder, the drying fabric carrying the web about the drying cylinder.

12. The drying section of claim 1, wherein the counter roll comprises a rotatable roll body and a heatable sleeve loosely encircling the roll body so as to allow free expansion and contraction of the sleeve relative to the roll body.

* * * * *